US007360492B2

(12) United States Patent
Konishi et al.

(10) Patent No.: US 7,360,492 B2
(45) Date of Patent: Apr. 22, 2008

(54) RAILWAY CAR WITH OVERLOAD DETECTOR

(75) Inventors: Kenta Konishi, Kudamatsu (JP); Eiji Harada, Kudamatsu (JP)

(73) Assignee: Hitachi, Ltd., Tokyo (JP)

( * ) Notice: Subject to any disclaimer, the term of this patent is extended or adjusted under 35 U.S.C. 154(b) by 135 days.

(21) Appl. No.: 11/211,514

(22) Filed: Aug. 26, 2005

(65) Prior Publication Data

US 2006/0174797 A1 Aug. 10, 2006

(30) Foreign Application Priority Data

Feb. 9, 2005 (JP) ..... 2005-032692

(51) Int. Cl.
*B61G 17/00* (2006.01)

(52) U.S. Cl. ..... 105/3; 73/37; 73/11.07; 700/301; 105/199.1; 105/453; 701/37

(58) Field of Classification Search ..... 105/3, 105/4.1, 4.2, 4.3, 453, 199.1; 73/729.1, 700, 73/712, 723, 37, 11.07; 701/29, 37; 700/301; 177/208, 209

See application file for complete search history.

(56) References Cited

U.S. PATENT DOCUMENTS 2,079,747 A * 5/1937 Mussey et al. ..... 105/4.1
3,612,621 A 10/1971 Scott
4,091,738 A 5/1978 Platner
4,693,185 A 9/1987 Easton et al.
4,756,548 A 7/1988 Kaltenthaler et al.
2004/0046442 A1* 3/2004 Aurich et al. ..... 303/7

FOREIGN PATENT DOCUMENTS

DE 1010094 6/1957
EP 1 190 926 A2 3/2002
JP 5-199604 8/1993

* cited by examiner

*Primary Examiner*—Mark T. Le
(74) *Attorney, Agent, or Firm*—Antonelli, Terry, Stout & Kraus, LLP.

(57) ABSTRACT

The invention provides an overload detector with a simplified system configuration to be applied to a railway car having a connecting bogie. A connecting bogie 52 (two axle bogie) having front and rear wheels 52C and 52D are disposed to extend between a first car $C_1$ and a second car $C_2$. The front and rear cars $C_1$ and $C_2$ are supported via air springs 52A and 52B on the connecting bogie 52. The other end of the car $C_1$ is supported via air springs 51A and 51B on a bogie 51 (two axle bogie) having front and rear wheels 51C and 51D. The other end of the car $C_2$ is supported via air springs 53A and 53B on a bogie 53 (two axle bogie) having front and rear wheels 53C and 53D. Pneumoelectric converters 41 and 42 are disposed along paths of pneumatic pipings 21 and 22, and the inner pressure of air springs 51A and 51B is converted into an inner pressure signal AS1, and the inner pressure $P_{AS2}$ of the air springs 52A and 52B is converted into an inner pressure signal AS2. The inner pressure signals AS1 and AS2 output from the pneumoelectric converters 41 and 42 are input to a computing processor 3. Overload is determined based on signals AS1 and AS2.

4 Claims, 4 Drawing Sheets

RAILWAY CAR WITH OVERLOAD DETECTOR

The present application is based on and claims priority of Japanese patent application No. 2005-32692 filed on Feb. 9, 2005, the entire contents of which are hereby incorporated by reference.

BACKGROUND OF THE INVENTION

1. Field of the Invention

The present invention relates to a railway car with an overload detector that prevents damage to the railway car and rail tracks caused by overload.

2. Description of the Related Art

Ordinary railway cars support car bodies via air springs on bogies. Japanese Patent Laid-Open Publication No. 5-199604 (Patent document 1) discloses an example of detecting the varied car weight caused by the variation of the number of passengers. The disclosure relates to a loading system for a railway car that converts the air pressure of a plurality of air springs via pneumoelectric converters into electric signals and outputs the same as loading signals. The disclosed pressure sensor detects the inner pressure of all the air springs when applied to a railway car formation in which plural car bodies are connected.

A railway car with a connecting bogie is known in which a connecting bogie is disposed between and connecting two adjacent cars in order to cut down cost of both the railway car and the manufacturing facility. In a railway car adopting such connecting bogies, the restriction of car weight is very severe compared to other railway cars. Thus, when operating the railway car having connecting bogies, a strict load control for each bogie must be carried out so that the load applied on the car body and the track does not exceed the limited range. If the prior art load detector is adopted to detect the car weight varied by the number of passengers, the air pressure of every air spring on the car must be detected. Therefore, the pressure detector must be disposed on every air spring, and a pneumatic piping must be arranged to connect every air spring and the pressure detector. Such arrangement increases not only the cost of the railway car but also the weight of the car body.

SUMMARY OF THE INVENTION

The present invention aims at providing an overload detector with a simple structure to be applied to a railway car with a connecting bogie.

In order to achieve the above-mentioned object, the present invention provides a railway car having a two-car formation with a connecting bogie, comprising a first car body and a second car body supported via air springs on the connecting bogie and the other sides of the first and second car bodies supported via air springs on other bogies, and an overload detector for detecting overload by measuring inner pressures of air springs attached to two bogies selected arbitrarily from the three bogies and predicting the inner pressures of all the air springs. Moreover, when it is determined that the inner pressure of the air spring has exceeded a specified value, the system outputs a command signal to other electric circuits.

Further, the present invention provides a railway car having a three-car formation with a connecting bogie, comprising a first car body and a second car body supported via air springs on a connecting bogie and also having the second car body and a third car body supported via air springs on a connecting bogie, the other sides of the first and third car bodies supported via air springs on other bogies, and an overload detector for detecting overload by measuring inner pressures of air springs attached to three bogies selected arbitrarily from the four bogies and predicting the inner pressures of all the air springs. Moreover, when it is determined that the inner pressure of the air spring has exceeded a specified value, the system outputs a command signal to other electric circuits.

The present invention provides an overload detector with a simplified structure to be applied to a railway car with a connecting bogie.

DETAILED DESCRIPTION OF THE PREFERRED EMBODIMENTS

The preferred embodiments of the present invention will now be described with reference to the drawings.

Figure 2:
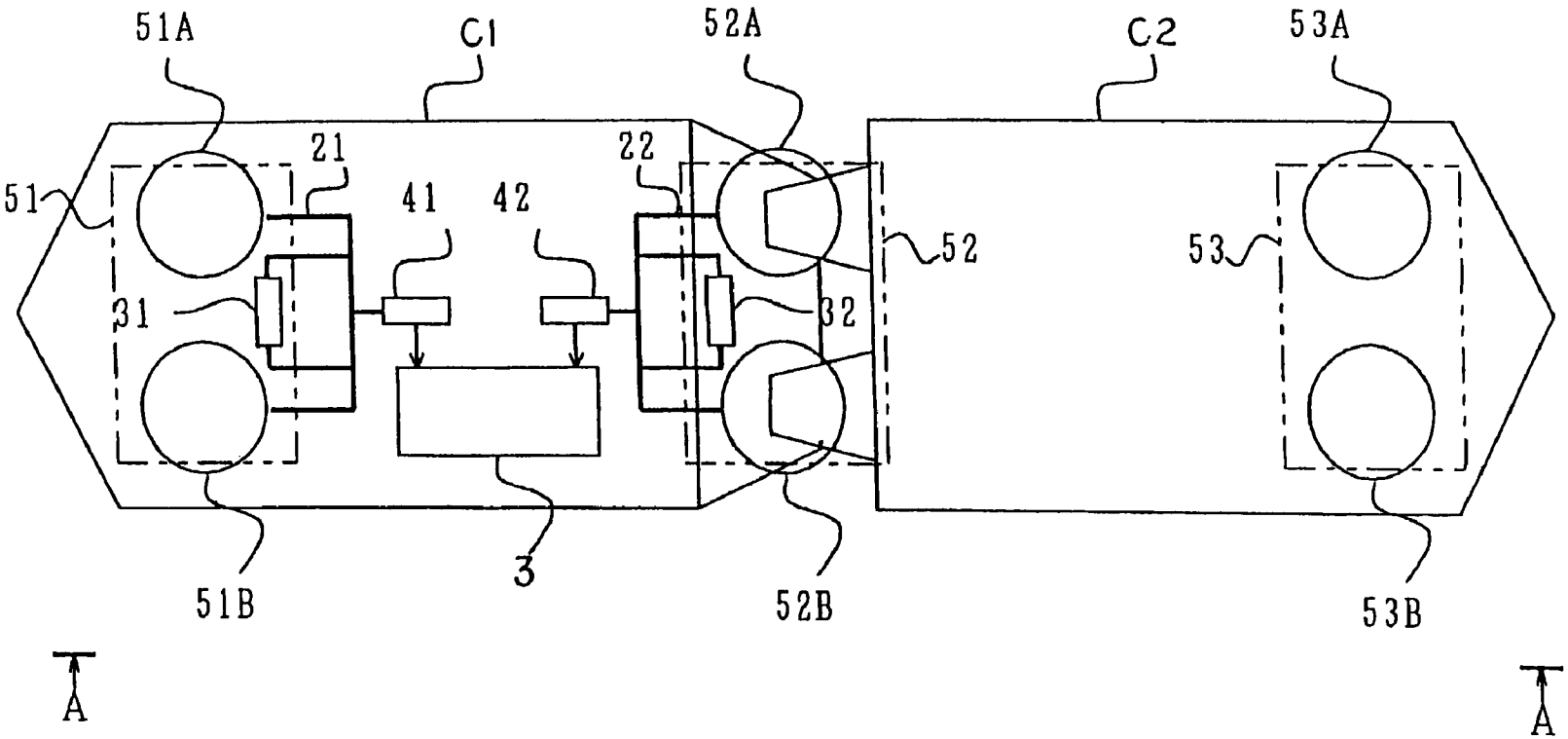
FIG. 2 is an explanatory view showing an embodiment of a two-car formation railway car with a connecting bogie.
Figure 3:
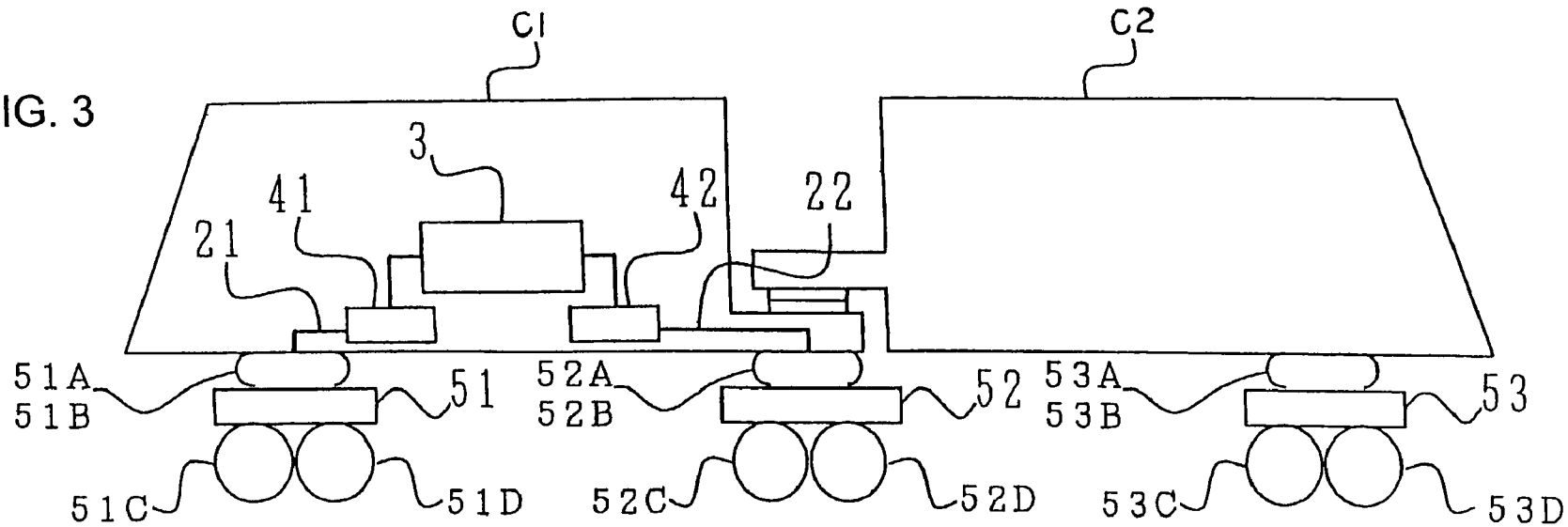
FIG. 3 is an explanatory view showing an embodiment of the two-car formation railway car with a connecting bogie.

FIG. 2 is an explanatory view of a two-car train with a connecting bogie based on one preferred embodiment of an overload detector according to a railway car with a connecting bogie of the present invention, and FIG. 3 is a view taken at arrow A-A of FIG. 2.

As shown in FIGS. 2 and 3, a connecting bogie 52 (two axle bogie) having front and rear wheels 52C and 52D is disposed to extend across a first car body $C_1$ and a second car body $C_2$. The car bodies $C_1$ and $C_2$ disposed in front of and behind the connecting bogie 52 are supported via air springs 52A and 52B on the connecting bogie 52. The car body $C_1$ has its opposite end supported via air springs 51A and 51B on a bogie 51 (two axle bogie) having front and rear wheels 51C and 51D. The car body $C_2$ has its opposite end supported via air springs 53A and 53B on a bogie 53 (two axle bogie) having front and rear wheels 53C and 53D. The railway car adopts a structure in which the weight of the car body $C_1$ is applied on the air springs 51A, 51B, 52A and 52B, and the weight of the car body $C_2$ is applied on the air springs 52A, 52B, 53A and 53B.

The air springs 51A and 51B and air springs 52A and 52B attached to both left and right sides of the bogies 51, 52 and 53 are connected via pneumatic pipings 21 and 22. A differential pressure regulating valve 31 is installed along the path of the pneumatic piping 21 and a differential pressure regulating valve 32 is installed along the path of the pneumatic piping 22. The inner pressures of the air springs 51A and 51B are equalized by the differential pressure regulating valve 31 and the inner pressures of the air springs 52A and 52B are equalized by the differential pressure regulating valve 32.

Pneumoelectric converters 41 and 42 are provided along the paths of the pneumatic pipings 21 and 22, by which the inner pressure of the air springs 51A and 51B is converted into an inner pressure signal AS1, and the inner pressure $P_{AS2}$ of the air springs 52A and 52B is converted into an inner pressure signal AS2. According to the present arrangement, the inner pressure signals AS1 and AS2 output from the pneumoelectric converters 41 and 42 are input to a computing processor 3.

Figure 1:
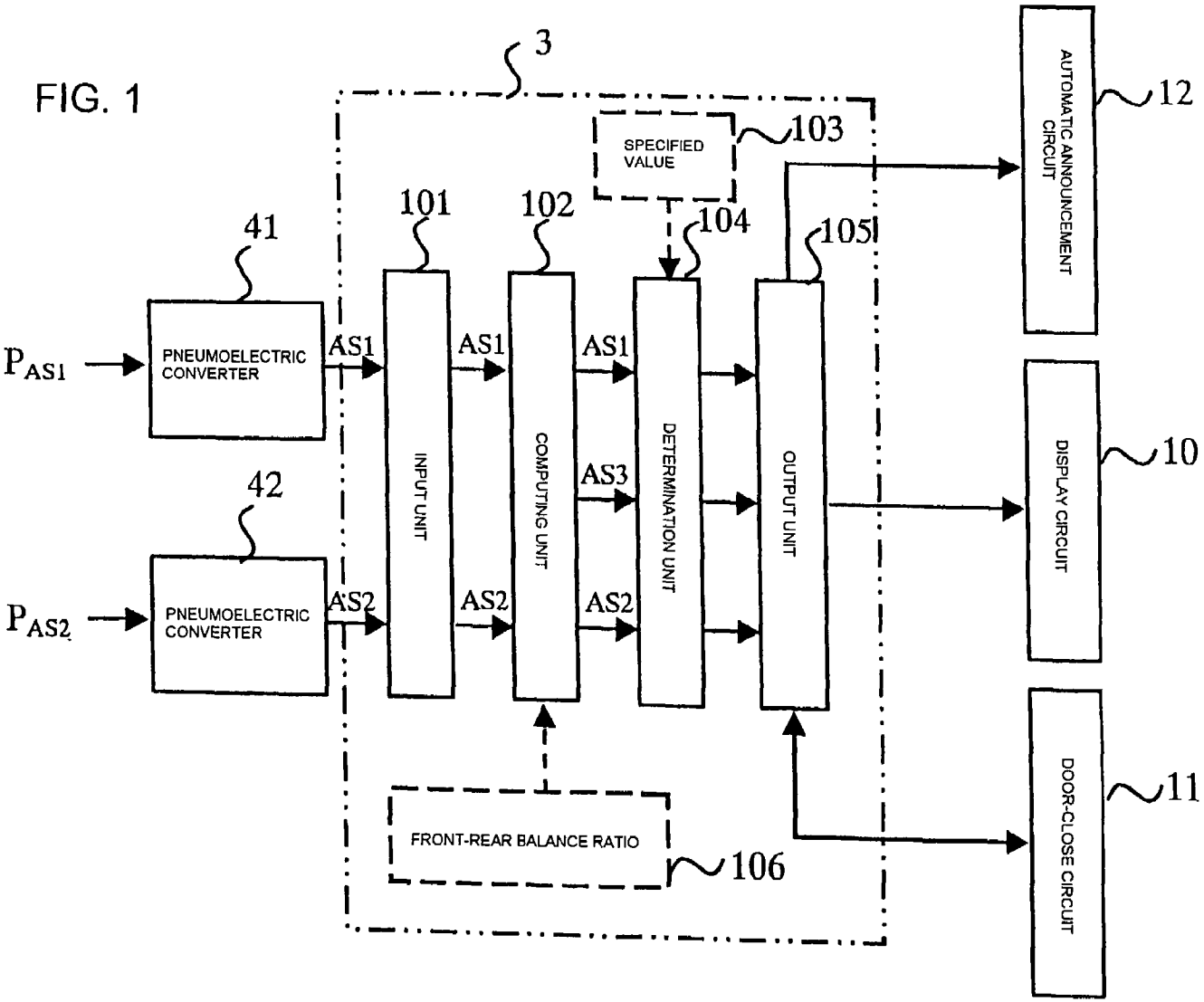
FIG. 1 is a functional block diagram of a computing processor according to the present invention.

FIG. 1 is a functional block diagram showing one embodiment of a computing processor 3 composed of a microcomputer and the like. The inner pressure $P_{AS1}$ of the air springs 51A and 51B and the inner pressure $P_{AS2}$ of the air springs 52A and 52B are converted by pneumoelectric converters 41 and 42 into inner pressure signals AS1 and AS2, and input to the computing processor 3. The computing processor 3 includes an input unit 101 into which the inner pressure signals AS1 and AS2 are input, a computing unit 102 for predicting the inner pressure value $P_{AS3}$ of air springs 53A and 53B based on the inner pressure signals AS1 and AS2 being input and a front-rear balance ratio 106 described in detail later, a determination unit 104 (comparing means) for determining whether or not the three inner pressure signals AS1, AS2 and AS3 are within a predetermined specified value 103, and an output unit 105 for sending command signals to a display circuit 10, a door close circuit 11 and an automatic announcement circuit 12 based on the result at the determination unit 104.

Figure 4:
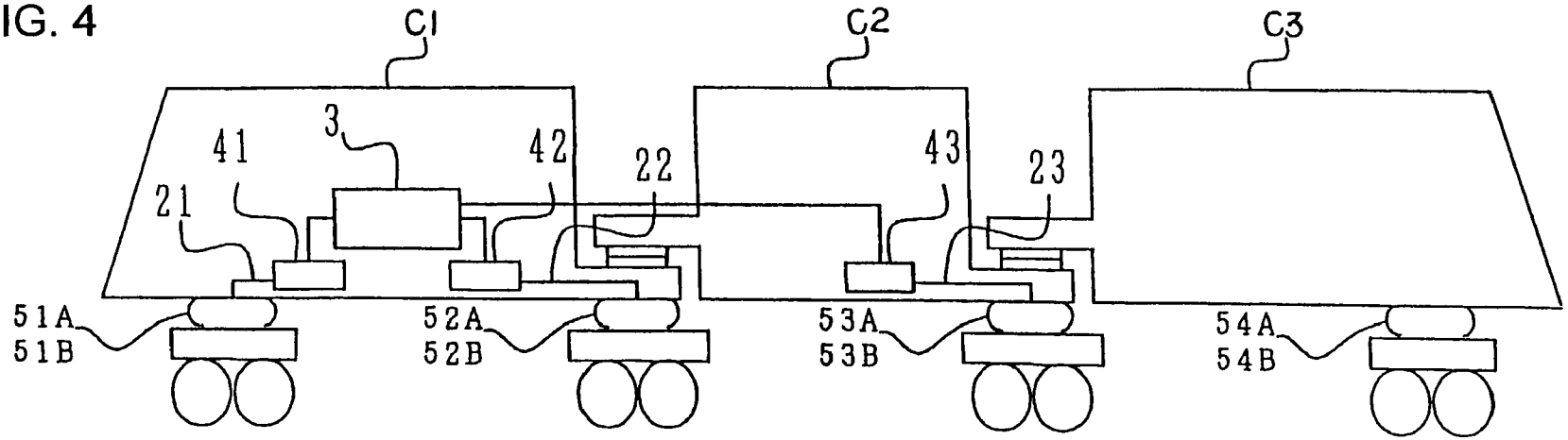
FIG. 4 is an explanatory view showing an embodiment of a three-car formation railway car with connecting bogies.

The computing unit 102 computes the inner pressure $P_{AS3}$ of air springs 53A and 53B, which is not actually measured, based on the inner pressure signals AS1 and AS2 and the front-rear balance ratio 106 described in detail below. For example, when the weights of cars $C_1$ and $C_2$ illustrated in FIGS. 2 through 4 are represented by $W_1$ and $W_2$, the weight $W_1$ is applied to bogies 51 and 52 with a front-rear balance ratio of $a_1:b_1$ while the weight $W_2$ is applied to bogies 52 and 53 with a front-rear balance ratio of $a_2:b_2$, and the effective cross-sectional area of the air spring is represented by S, the inner pressure $P_{AS1}$ of the air springs 51A and 52B, the inner pressure $P_{AS2}$ of the air springs 52A and 52B and the inner pressure $P_{AS3}$ of the air springs 53A and 53B can each be represented by the following equations.

[Equation 1] (1)

$$P_{AS1} = \frac{a_1 W_1}{2s}$$

[Equation 2] (2)

$$P_{AS2} = \frac{b_1 W_1 + a_2 W_2}{2s}$$

[Equation 3] (3)

$$P_{AS3} = \frac{b_2 W_2}{2s}$$

According to equations (1) (2) and (3), the front-rear balance ratios $\mathbf{106}_{a1}$, $\mathbf{106}_{b1}$, $\mathbf{106}_{a2}$ and $\mathbf{106}_{b2}$ are designed values. The computing unit 102 can calculate the inner pressure $P_{AS3}$ of air springs 53A and 53B if the inner pressure signal AS1 obtained through pneumoelectric conversion of the inner pressure $P_{AS1}$ of the air springs 51A and 51B and the inner pressure signal AS2 obtained through pneumoelectric conversion of the inner pressure $P_{AS2}$ of the air springs 52A and 52 are provided.

The determination unit 104 compares in advance the specified value 103 set with respect to the air springs 51A, 51B, 52A, 52B, 53A and 53B, with the inner pressure signals AS1, AS2 and AS3 computed by the computing unit 102.

In order to detect the inner pressure of the air springs attached to all the bogies, it is necessary to install pneumoelectric converters to the air springs of all bogies, and to put the obtained electric signals through computing processes. However, according to the present embodiment, by installing electrpneumatic converters 41 and 42 and a computing processor 3 to only the first car, the inner pressure $P_{AS3}$ of air springs 53A and 53B disposed on the second car can be predicted.

Similar to the aforementioned embodiment, the pneumoelectric converters and the computing processor can be disposed only on the second car to predict the inner pressure of the air springs installed on the first car.

The following is a description of an embodiment in which a similar overload detecting method is applied to a railway car having a three-car formation. As shown in FIG. 4, the weight of the car body $C_1$ is applied on the air springs 51A, 51B, 52A and 52B, the weight of the car body $C_2$ is applied on the air springs 52A, 52B, 53A and 53B, and the weight of the car body $C_3$ is applied on the air springs 53A, 53B, 54A and 54B. A pneumoelectric converter 41 is installed along the path of a pneumatic piping 21 connecting the air springs 51A and 51B, which converts the inner pressure $P_{AS1}$ of the air springs 51A and 51B into an inner pressure signal AS1. A pneumoelectric converter 42 is installed along the path of a pneumatic piping 22 connecting the air springs 52A and 52B, which converts the inner pressure $P_{AS2}$ of the air springs 52A and 52B into an inner pressure signal AS2. Further, a pneumoelectric converter 43 is installed along the path of a pneumatic piping 23 connecting the air springs 53A and 53B, which converts the inner pressure $P_{AS3}$ of the air springs 53A and 53B into an inner pressure signal AS3. By inputting the inner pressure signals AS1, AS2 and AS3 to a computing processor 3, the inner pressure $P_{AS4}$ of air springs 54A and 54B can be predicated similarly as the embodiment of the two-car formation.

The present invention can further be applied to a railway car of a four-car formation or more having connecting bogies, by combining the above-described detecting methods for the two-car formation and the three-car formation.

What is claimed is:

1. A railway car having a two-car formation with a connecting bogie, comprising:

a first car body and a second car body supported via air springs on the connecting bogie and the other sides of the first and second car bodies supported via air springs on other bogies; and pressure sensors for measuring inner pressures of air springs attached to two bogies selected arbitrarily from the three bogies; and a computing unit for predicting the inner pressure of the air spring of the third bogie by measuring the inner pressures of the air springs of the two bogie.

2. The railway car according to claim 1, further comprising a comparing unit for comparing the inner pressure of the air spring with a specified value, wherein the overload detector outputs a command signal to other electric circuits when the inner pressure of the air spring has exceeded the specified value.

3. A railway car having a three-car formation with a connecting bogie, comprising:

a first car body and a second car body supported via air springs on a connecting bogie and also having the second car body and a third car body supported via air springs on a connecting bogie, the other sides of the first and third car bodies supported via air springs on other bogies; and pressure sensors for measuring inner pressures of air springs attached to three bogies selected arbitrarily from the four bogies; and a computing unit for predicting the inner pressure of the air spring of the fourth bogie by measuring the inner pressures of the air springs of the three bogies.

4. The railway car according to claim 3, further comprising a comparing unit for comparing the inner pressure of the air spring with a specified value, wherein the overload detector outputs a command signal to other electric circuits when the inner pressure of the air spring has exceeded the specified value.

* * * * *